US009926775B2

(12) United States Patent
O'Rear et al.

(10) Patent No.: US 9,926,775 B2
(45) Date of Patent: Mar. 27, 2018

(54) PROCESS FOR MERCURY REMOVAL

(71) Applicant: Chevron U.S.A. Inc., San Ramon, CA (US)

(72) Inventors: Dennis John O'Rear, Petaluma, CA (US); Russell Evan Cooper, San Ramon, CA (US); Wei Wang, Katy, TX (US); Sujin Yean, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 347 days.

(21) Appl. No.: 14/789,647

(22) Filed: Jul. 1, 2015

(65) Prior Publication Data

US 2016/0003023 A1 Jan. 7, 2016

Related U.S. Application Data

(60) Provisional application No. 62/020,083, filed on Jul. 2, 2014.

(51) Int. Cl.

| | |
|---|---|
| ***E21B 43/38*** | (2006.01) |
| ***E21B 43/34*** | (2006.01) |
| ***C10L 3/10*** | (2006.01) |
| ***E21B 49/00*** | (2006.01) |
| ***E21B 41/00*** | (2006.01) |
| ***E21B 43/00*** | (2006.01) |
| ***E21B 47/10*** | (2012.01) |
| *E21B 49/08* | (2006.01) |

(52) U.S. Cl.

CPC ..... *E21B 43/34* (2013.01); *C10L 3/101* (2013.01); *E21B 41/0092* (2013.01); *E21B 43/00* (2013.01); *E21B 47/10* (2013.01); *E21B 49/00* (2013.01); *C10L 2290/544* (2013.01); *C10L 2290/547* (2013.01); *C10L 2290/58* (2013.01); *C10L 2290/60* (2013.01); *E21B 2049/085* (2013.01)

(58) Field of Classification Search

CPC ..... E21B 43/34; E21B 43/38

See application file for complete search history.

(56) References Cited

U.S. PATENT DOCUMENTS

| | | | | |
|---|---|---|---|---|
| 2,320,681 | A | 6/1943 | Thompson | |
| 4,983,277 | A * | 1/1991 | Audeh | C10G 25/00 208/251 R |
| 4,990,773 | A | 2/1991 | Supernaw | |
| 5,063,509 | A | 11/1991 | Coles | |
| 6,117,333 | A | 9/2000 | Frankiewicz et al. | |
| 6,210,078 | B1 * | 4/2001 | Redwine | B01D 61/16 134/28 |
| 6,537,443 | B1 | 3/2003 | Frankiewicz | |
| 6,685,824 | B2 | 2/2004 | Frankiewicz | |
| 6,715,347 | B2 | 4/2004 | Zamfes | |
| 7,363,972 | B2 * | 4/2008 | Dybdahl | E21B 49/081 166/250.01 |
| 8,037,935 | B2 * | 10/2011 | Pelletier | E21B 49/10 166/100 |
| 8,434,556 | B2 * | 5/2013 | Jamaluddin | E21B 37/06 166/228 |
| 8,492,154 | B1 | 7/2013 | Schabron | |
| 8,530,240 | B1 | 9/2013 | Schabron | |
| 8,673,133 | B2 | 3/2014 | Yean et al. | |
| 8,728,303 | B2 | 5/2014 | Young et al. | |
| 8,728,304 | B2 | 5/2014 | Gallup et al. | |
| 8,790,427 | B2 | 7/2014 | O'Rear et al. | |
| 8,840,691 | B2 | 9/2014 | Cooper et al. | |
| 8,906,228 | B2 | 12/2014 | O'Rear et al. | |
| 8,938,045 | B2 | 1/2015 | Dworkin | |
| 8,967,249 | B2 | 3/2015 | Akkurt | |
| 8,992,769 | B2 | 3/2015 | O'Rear et al. | |
| 9,023,123 | B2 | 5/2015 | O'Rear et al. | |
| 9,023,196 | B2 | 5/2015 | Coooper et al. | |
| 2003/0116475 | A1 | 6/2003 | Frankiewicz et al. | |
| 2008/0061789 | A1 | 3/2008 | Coates | |
| 2008/0066534 | A1 | 3/2008 | Reid | |
| 2009/0274276 | A1 | 11/2009 | Wraight | |
| 2010/0000910 | A1 | 1/2010 | Gallup et al. | |
| 2010/0258265 | A1 | 10/2010 | Karanikas et al. | |
| 2011/0247809 | A1 * | 10/2011 | Lin | E21B 43/24 166/272.1 |
| 2012/0067784 | A1 | 3/2012 | Gallup et al. | |
| 2012/0067785 | A1 | 3/2012 | Gallup et al. | |

(Continued)

FOREIGN PATENT DOCUMENTS

| | | |
|---|---|---|
| WO | 2011061662 | 5/2011 |

OTHER PUBLICATIONS

International Search Report dated Oct. 6, 2015 for PCT Application No. PCT/US2015/038873.

"Horizontal and vertical variabilities of mercury concentration and specification in sediments of the Gdansk Basin, Southern Baltic Sea", Chemosphere 52, (2003), pp. 645-654.

*Primary Examiner* — Kenneth L Thompson

(74) *Attorney, Agent, or Firm* — Howard V. Owens

(57) ABSTRACT

A predictive tool is provided for estimating the mercury content of hydrocarbons to be produced from a wellbore in a newly investigated subterranean hydrocarbon producing formation based on the mercury content of an inorganic sample recovered from the wellbore. The mercaptans content of liquid hydrocarbons and/or the hydrogen sulfide content of natural gas produced from the formation may also be used to enhance the prediction. Based on the predicted value, a mercury mitigation treatment may be provided to mitigate the mercury content of hydrocarbons produced from the formation.

20 Claims, No Drawings

(56) References Cited

U.S. PATENT DOCUMENTS

| | | | | |
|---|---|---|---|---|
| 2012/0125817 | A1 | 5/2012 | Yean et al. | |
| 2012/0125818 | A1 | 5/2012 | O'Rear et al. | |
| 2012/0125820 | A1 | 5/2012 | Yean | |
| 2013/0028371 | A1 | 1/2013 | Derzhi | |
| 2013/0240267 | A1 | 9/2013 | Aleksandersen | |
| 2013/0269933 | A1 | 10/2013 | Pomerantz | |
| 2013/0306310 | A1* | 11/2013 | Gallup | C10G 21/08 166/267 |
| 2013/0306311 | A1 | 11/2013 | Cooper et al. | |
| 2014/0005945 | A1 | 1/2014 | Anand | |
| 2014/0066683 | A1 | 3/2014 | O'Rear et al. | |
| 2014/0119497 | A1 | 5/2014 | Guzman | |
| 2014/0151040 | A1 | 6/2014 | Yean et al. | |
| 2014/0157870 | A1 | 6/2014 | Kornacki | |
| 2014/0158353 | A1 | 6/2014 | Yean et al. | |
| 2014/0165701 | A1 | 6/2014 | Wu | |
| 2014/0275665 | A1 | 9/2014 | O'Rear et al. | |
| 2014/0275694 | A1 | 9/2014 | Cooper et al. | |
| 2015/0076035 | A1 | 3/2015 | O'Rear et al. | |
| 2016/0251582 | A1* | 9/2016 | O'Rear | C04B 18/0472 166/265 |
| 2017/0158976 | A1* | 6/2017 | O'Rear | C10L 3/101 |

* cited by examiner

PROCESS FOR MERCURY REMOVAL

CROSS-REFERENCE TO RELATED APPLICATIONS

The present application claims priority from U.S. Provisional Application No. 62/020,083, with filing date of Jul. 2, 2014, the entire disclosure of which is incorporated herein by reference for all purposes.

TECHNICAL FIELD

The invention relates generally to a process, method, and system for removing heavy metals such as mercury from hydrocarbon fluids such as crude oil and natural gas.

BACKGROUND

Mercury and other heavy metals can be present in many types of naturally occurring hydrocarbons such as crude oil and natural gas. The amount can range from below the analytical detection limit (0.5 μg/kg) to several thousand parts per billion by weight depending on the feed source. It is desirable to remove the trace elements of these metals from crude oils.

Historically, mercury has been determined to occur in crude oils and natural gas well into commercial production, after processes and equipment are in place to handle the production. Recognizing the need for mercury mitigation at that point often results in cost overruns, scheduling delays, and changes in scope of the work. An approach that has been suggested includes measuring the mercury content of crude oil and/or natural gas samples that are collected during the exploratory phase of, or during preparation or completion of a well in, a newly investigated production zone, and before production processes and equipment are in place. However, mercury analyses of these initial hydrocarbon samples have been found to be unreliable and often inaccurate.

An improved method for predicting the mercury content of production fluids from a newly investigated production zone is desired.

SUMMARY

In one aspect, the invention relates to a method for producing hydrocarbons having reduced mercury content from a newly investigated production zone. The method includes: analyzing a mercury content of at least one inorganic matrix sample from a newly investigated production zone; analyzing a mercaptans content of at least one crude oil sample recovered from the newly investigated production zone; setting a mercury threshold value for mercury content of the at least one inorganic sample; setting a mercaptans threshold value for the mercaptans content of the at least one crude oil sample; and providing mercury mitigation treatment for removing at least a portion of the mercury from natural gas to be produced from the newly investigated production zone when the mercury content of the at least one inorganic sample exceeds the threshold value, and the mercaptans content of the at least one crude oil sample is less than the mercaptans threshold value. In one embodiment, the mercury threshold value is 10 parts per billion by weight; in another embodiment, 100 parts per billion by weight. In one embodiment, the mercaptans threshold value is 3 parts per million by weight; in another embodiment, 25 parts per million by weight. In one embodiment, the inorganic matrix sample is ground; and the fraction having a particle size of at most 40 mesh is evaluated for mercury content.

In another aspect, the invention relates to a method for evaluating the mercury level in natural gas to be extracted from a newly investigated production zone. The method includes providing a knowledge base of data from hydrocarbon producing formations, the data correlating at least one of mercury contents of inorganic matrix samples from a multiplicity of producing formations; and mercaptans contents of liquid crude oil samples from the multiplicity of producing formations with the mercury content of natural gas from the multiplicity of producing formations; analyzing at least one of a mercury content of at least one inorganic matrix sample from the newly investigated production zone and a mercaptans content of at least one crude oil sample from the newly investigated production zone; and evaluating the knowledge base with at least one of the mercury content of the inorganic matrix sample and the mercaptans content of the crude oil sample from the newly investigated production zone to predict the mercury content of hydrocarbons from the newly investigated production zone.

In yet another aspect, the invention relates to a method for producing hydrocarbons having reduced mercury content from a newly investigated production zone, comprising: setting a threshold value for mercury content of natural gas to be produced from a newly investigated production zone; providing a knowledge base of data from hydrocarbon producing formations, the data correlating mercury contents of inorganic matrix samples from a multiplicity of producing formations with mercury contents of natural gas from the multiplicity of producing formations; analyzing a mercury content of at least one inorganic matrix sample from a newly investigated production zone; evaluating the knowledge base with the mercury content of the inorganic matrix sample to predict the mercury content of natural gas to be produced from the newly investigated production zone; and providing mercury mitigation treatment for removing at least a portion of the mercury from natural gas to be produced from the newly investigated production zone when the predicted mercury content of the natural gas exceeds the threshold value. In one such embodiment, the threshold value for mercury content of natural gas is 10 parts per billion; in another embodiment, 100 parts per billion.

In yet another aspect, the invention relates to a method for evaluating the mercury content in a hydrocarbon to be produced from a newly investigated production zone in a subterranean formation, the method comprising: providing a knowledge base of data from a plurality of hydrocarbon production zones, the data correlating a mercury content of a hydrocarbon produced from each of the plurality of production zones with at least one of (a) a mercury content of at least one inorganic matrix sample from each of the plurality of hydrocarbon production zones; (b) a mercaptans content of at least one liquid crude oil sample from each the plurality of production zones; and (c) a hydrogen sulfide content of at least one natural gas sample from each of the plurality of production zones; the invention further comprising evaluating the knowledge base of data using at least one measured value from a newly investigated production zone, the measured value selected from the group consisting of a mercury content of an inorganic matrix sample from the newly investigated production zone, a mercaptans content of a liquid crude oil sample from the newly investigated production zone, and a hydrogen sulfide content of a natural gas sample from the newly investigated production zone as inputs to the knowledge base; the invention further comprising predicting the mercury content of the hydrocarbon to be produced from the newly investigated production zone; the invention further comprising providing a mercury mitigation treatment for removing at least a portion of the mercury from the hydrocarbon to be produced when the predicted mercury content of the hydrocarbon is greater than a threshold mercury content.

In one embodiment, a wellbore extends into a plurality of production zones, at least one of which is predicted to produce mercury-containing hydrocarbons, and wherein the mercury mitigation treatment comprises blocking production from the at least one production zone that is predicted to produce mercury-containing hydrocarbons (e.g. containing greater than 100 parts per billion by weight).

In one embodiment, the mercury mitigation treatment is operated during periods of hydrocarbon production when the predicted mercury content of the hydrocarbon is greater than the threshold value, and is not operated during periods of hydrocarbon production when the predicted mercury content of the hydrocarbon is less than or equal to the threshold value.

DETAILED DESCRIPTION

Systems and methods are provided for predicting mercury concentrations in production fluids recovered from a production zone of a subterranean formation. The method can be employed to plan for equipment needs during the exploratory phase of a newly investigated production zone. It is useful for producing hydrocarbons having a reduced mercury content. The method is also useful for providing a processing facility for mitigating mercury in produced hydrocarbons at a production site, and/or prior to starting full-scale hydrocarbon production at the site. In one embodiment, the predictive capabilities provided by the method facilitate development of a mercury mitigation system in a hydrocarbon processing facility for a single well or for multiple wells in a hydrocarbon bearing subterranean formation. Additionally, the impact of mercury content from a new well on a group of wells that feed into a common hydrocarbon processing facility provides information that is useful for designing and operating the hydrocarbon processing facility.

The following terms will be used throughout the specification and will have the following meanings unless otherwise indicated.

"Subterranean formation" refers to a geological formation below the earth's surface. The subterranean formation may also encompass geological formations wholly or partially beneath marine or water-based bodies.

"Production zone" refers to a subterranean formation containing hydrocarbons in sufficient quantity to be recovered.

A "newly investigated production zone", refers to a subterranean formation that has been found to contain hydrocarbons, but has not been developed to a stage of commercial production. The newly investigated production zone, in some embodiments, may have been identified by a single exploratory wellbore drilled into the zone for ascertaining its potential for hydrocarbon production. Alternatively, the newly investigated production zone may have been identified using seismic surveys or other reservoir modeling techniques. Hydrocarbon samples and inorganic matrix samples are collected from the newly investigated production zone, for use in estimating the mercury content of production fluids, prior to commercial production of hydrocarbons from the production zone.

"Production site" includes the production well or wells through which the production fluids are recovered from the production zone. The production site may be land or water based. If on water, the site may include a production platform or a floating production storage unit or vessel. The production site may also include a hydrocarbon processing facility.

"Hydrocarbon" refers to petroleum products that are produced from the production zone. In one embodiment, the produced hydrocarbons are selected from the group consisting of crude oil, condensate, natural gas, and combinations thereof.

"Hydrocarbon" refers to solid, liquid or gaseous organic material of petroleum origin, that is principally hydrogen and carbon, with significantly smaller amounts (if any) of heteroatoms such as nitrogen, oxygen and sulfur. Crude oil refers to a hydrocarbon material that is liquid at ambient conditions (or higher or lower temperatures) or up to temperatures of 300° F. (or higher or lower), recovered from a production zone in a subterranean formation. In one embodiment, crude oil has a specific gravity >=0.75 at a temperature of 60° F. In another embodiment, the specific gravity is >=0.85. In a third embodiment, the specific gravity is >=0.90. Crude, crude oil, crudes and crude blends are used interchangeably and each is intended to include both a single crude and blends of crudes. Condensate is recovered as vapors at an elevated temperature during crude oil or natural gas production, but condenses to liquid phase hydrocarbons at ambient conditions. A typical condensate has a carbon number in a $C_3$-$C_{40}$ range, and in embodiments in a $C_4$-$C_{30}$ range. "Natural gas" includes hydrocarbons that are normally gaseous to a significant extent at ambient conditions. In one embodiment, natural gas includes hydrocarbons having carbon numbers between $C_1$ and $C_5$. In another embodiment, natural gas includes hydrocarbons having carbon numbers between $C_1$ and $C_3$. In another embodiment, natural gas includes methane with increasingly smaller quantities of higher carbon number hydrocarbons.

"Production wellbore" refers to a wellbore through which production fluids are carried from an oil-bearing subterranean formation to the earth's surface, whether the surface is water or land. Surface facilities are provided for handling and processing the crude from the formation as it arrives on the surface, whether on land at land-based installations or on a platform at marine based installations.

"Production fluids" refers to the liquid and/or gaseous fluids comprising principally liquid and/or gaseous hydrocarbons that are recovered from a subterranean production zone. "Aqueous production fluids" refers to water or an aqueous fluid that is native to the formation or introduced to the formation during at least one of exploration, drilling, and production, whether under formation temperature and pressure or under enhanced production conditions, or a mixture thereof. Aqueous production fluids may be produced along with the hydrocarbons.

A "hydrocarbon processing facility" may be provided at a production site to condition the organic production fluids for transport. Conditioning may include, for example, separating liquids and gases and removing water and sediments from the hydrocarbons. The liquid hydrocarbons may be further conditioned to meet a vapor pressure specification for shipment. The gaseous hydrocarbons may be further conditioned to meet dew point specifications. Aqueous production fluids may be treated for disposal or for reinjection into the formation. Gaseous hydrocarbons may also be treated for reinjection into the formation. The hydrocarbon processing facility may be either on-shore, on a production platform, or on a floating production storage unit or vessel. The hydrocarbon processing facility may be used to handle the production from a single well, or from multiple wells in a field. In general, the hydrocarbon processing facility will be equipped to process production fluids from the production zone, depending on the types and amounts of hydrocarbons produced from the zone. As required by the specific requirements of the production fluids, the hydrocarbon processing facility may also include the capability of removing mercury from the production fluids using a mercury mitigation treatment.

"Mercury mitigation treatment" refers to a process(s) for removing mercury from a target material, e.g. production fluids or aqueous production fluids.

"Trace amount" refers to the amount of mercury in the crude oil. The amount varies depending on the crude oil source and ranges from a few parts per billion by weight to up to 30,000 parts per billion.

"Mercury sulfide" may be used interchangeably with HgS, referring to mercurous sulfide, mercuric sulfide, and mixtures thereof. Normally, mercury sulfide is present as mercuric sulfide with an approximate stoichiometric equivalent of one mole of sulfide ion per mole of mercury ion. Crystalline phases include cinnabar, metacinnabar and hypercinnabar with metacinnabar being the most common "Mercury salt" or "mercury complex" means a chemical compound formed by replacing all or part of hydrogen ions of an acid with one or more mercury ions.

"Inorganic sample" or "inorganic material" or "inorganic matrix" are used herein to designate the inorganic portion of the subterranean formation. In one aspect, inorganic material that is brought to the surface during the drilling operation constitutes an example of an inorganic sample. In another aspect, a core sample from the wellbore, or from a nearby boring to analyze the subterranean structure and the composition of the rock matrix in the region of the wellbore, is the inorganic sample. Drill cuttings, which are an example of the inorganic material, may include small amounts of organic matter, particularly drill cuttings which are recovered from a production zone of a subterranean formation. Drilling mud is another example of the inorganic material.

The method includes predicting the mercury content of production fluids from a newly investigated production zone, based on a mercury content of at least one inorganic matrix samples from the formation. The most representative samples will generally be collected from the region of, or within, the producing region of the formation. The mercury content of the production zone is represented by a mercury determination of, for example, a single matrix sample from the production zone, an average value of determinations from more than one matrix sample, or a mercury content determination of a blend of more than one matrix samples from the production zone.

Samples of the inorganic matrix to be analyzed are representative, at least with respect to mercury content, of the inorganic matrix in the producing region of the formation. The inorganic sample may be recovered as drill cuttings from a well drilling operation, solid samples of core material, sediments filtered from crude samples, pigging wastes, or other material from the formation itself. Routine methods for recovering drill cuttings from drilling fluids produced during the drilling operation are well known. As a well is drilled, drilling fluid is pumped downhole to facilitate drilling, cool and lubricate the drill bit, and remove solid particles from the wellbore. As the drilling fluid circulates through the wellbore, solid inorganic particles become entrained within the drilling fluid and are conveyed from the wellbore to the surface of the drilling operation. Methods for separating drill cuttings from the liquid portion of the drilling fluid are known, e.g. by filtering, centrifugation, settling. In the method, a cuttings sample is separated from liquid by methods known in the art, e.g., filtering or solvent extraction or a combination. The cleaned cuttings sample is then dried to remove residual solvent. Core samples that are analyzed for measurement of their mercury content may be solvent extracted or washed, dried and ground prior to mercury determination. It may be desirable to remove the outer layers from core and other inorganic samples as these may have been contaminated with drilling fluids.

The amount of mercury in the inorganic matrix of the production zone of the formation may also be predicted from the mercury content of drilling fluid that is circulated during preparation of the well. Analysis of the drilling fluid includes a measurement of the mercury content prior to circulating the drilling fluid into the well. Drilling fluids are frequently recycled from previous drilling operations. As such, the fluids may contain mercury, either from additives supplied to the fluids or as contaminants from previous drilling operations. In the process, a drilling fluid for use while preparing the wellbore in the region of the production zone is analyzed for its mercury content. Corresponding drilling fluid is recovered after circulating through the well and also analyzed for its mercury content. The difference in the two mercury determinations is an indication of the mercury content in the production zone of the formation.

The inorganic material may be ground under ambient conditions in air, or under an inert or a reducing atmosphere, such as, for example, hydrogen, nitrogen, helium, argon, synthesis gas, or any combination or mixture thereof. Any method or equipment may be used to grind the inorganic material, such as, for example, a hammer mill, a ball mill (such as a wet ball mill, a conical ball mill, a rubber roller mill), a rod mill, or a combination thereof.

In one embodiment, the inorganic material is ground, using a standard grinding method, and the fraction that passes through a 40 mesh screen is analyzed for mercury content. In another embodiment, the inorganic material is ground and the fraction that passes through a 100 mesh screen is analyzed. For analyses in which the mercury content of the inorganic matter is desired, the mercury content may be analyzed using, for example, a Hg vapor analyzer from OhioLumex (RA915+ mercury analyzer with attachment PYRO-915+), or for low levels a NIC analyzer.

In one embodiment, amount of mercury may be provided with an analysis of the drilling mud, with the change in the mercury level from the starting mud to the used mud. Drilling mud may already contain mercury from the barite or from previous use in another well. Analysis of drilling muds provides a continuous measurement as the well is drilled. In the continuous analysis of the drilling muds, if spikes in mercury level are observed, the measurements provide helpful input as whether to abandon the well and move on to another location.

In one embodiment, the mercury content of production fluids to be produced from the formation is predicted from the mercaptans content of liquid hydrocarbons from the production zone. A liquid hydrocarbon sample may be recovered during the drilling operation, using known methods for sampling the produced hydrocarbons while drilling or completing a well. The mercaptans react with elemental mercury to form mercuric sulfide at conditions in the subterranean formation. Thus, high levels of mercaptans suggest that elemental mercury may not be present. Conversely, low levels of mercaptans accompanying mercury in the inorganic matrix suggest that elemental mercury may be present and will contaminate the gas product. Methods for recovering liquid hydrocarbon samples from a hydrocarbon-bearing zone of a subterranean formation during well completion are well known. The liquid hydrocarbon is analyzed for mercaptans sulfur using a standard method, such as ASTM3227. As used herein, a thiol is an organo-sulfur compound that contains a carbon-bonded sulfhydryl (—C—SH or R—SH) group (where R represents an alkane, alkene, or other carbon-containing group of atoms). The term "thiol" is used interchangeably with "mercaptans." Representative mercaptans that may be present in the crude oil include the alkanethiols such as methanethiol ($CH_3SH$), ethanethiol ($C_2H_5SH$), 1-propanethiol ($C_3H_7SH$), 2-propanethiol ($CH_3CH(SH)CH_3$), butanethiol ($C_4H_9SH$), tert-butyl mercaptans ($C(CH_3)_3SH$), and tert-butyl mercaptans ($C(CH_3)_3SH$). In contrast to mercaptans, organic compounds in crude where the sulfur is in an aromatic ring are not capable of converting elemental mercury to mercuric sulfide. Examples of these aromatic sulfur compounds include thiophenes, benzothiophenes, and dibenzothiophenes. Therefore, the model must be based on a measurement of mercaptans in the crude or condensate, not the total sulfur.

A gaseous hydrocarbon sample recovered from a newly investigated production zone may provide further indication of the mercury content of natural gas from the production zone. The model for predicting the mercury content of produced hydrocarbons may include the hydrogen sulfide ($H_2S$) content of gaseous hydrocarbons from the production zone. A gaseous hydrocarbon sample from the production zone is analyzed for hydrogen sulfide using a standard method, such as ASTM D4084-07 (2012).

In one embodiment, the method includes providing a wellbore extending from the earth's surface, or from a drilling platform in a maritime location, to a hydrocarbon production zone of a subterranean formation which contains liquid crude oil and gaseous hydrocarbons. Methods are readily available for indicating when a drill string which is used to prepare the wellbore passes into a hydrocarbon-containing zone of the subterranean formation. Methods are further available for providing information indicating the amounts of hydrocarbons that may be predictably produced from the hydrocarbon-production zone. The wellbore may be used for collecting core samples from a subterranean formation, for investigating the hydrocarbon potential for the formation, for recovering hydrocarbons from the formation, or any combination.

A predictive model is provided for predicting an expected mercury content in hydrocarbons (e.g. natural gas and/or crude oil) from a newly investigated production zone, at a time prior to commercial production of organic fluids from the formation. In one embodiment, threshold mercury content in production fluids from the formation is useful in determining whether mercury mitigation equipment is indicated for treating the production fluids for the formation. In one embodiment, mercury mitigation treatment of hydrocarbons from the production zone is included in the design of a hydrocarbon processing facility for production fluids from the zone when the predicted mercury content of natural gas from the production zone exceeds a threshold of 10 parts per billion by weight; in another embodiment, when the predicted mercury content of the hydrocarbons exceeds a threshold of 50 parts per billion by weight; in another embodiment, when the predicted mercury content of the hydrocarbons exceeds a threshold of 100 parts per billion by weight. It may be more useful, in some situations, to report the mercury content of gaseous hydrocarbons (i.e. natural gas) in terms of micrograms (μg) per unit cubic meter ($m^3$). Accordingly, mercury in natural gas may be treated using the mercury mitigation treatment when the predicted mercury content exceeds a threshold of 6.5 $\mu g/m^3$, based on a molecular weight of 16; in another embodiment, a threshold of 32.5 $\mu g/m^3$; in another embodiment, a threshold of 65 $\mu g/m^3$.

In one embodiment, mercury analysis of inorganic matrix samples recovered from the production zone is indicative of mercury in the production fluids that will be produced from the production zone. Mercury is often present at much higher levels in these solid samples relative to the crude oil. In one embodiment, the mercury content of core or other formation samples indicating a mercury removal process is 10 parts per billion by weight or more. In other embodiments, mercury content of inorganic matrix samples of 100 parts per billion by weight or more, or of 500 parts per billion by weight or more, or of 1000 parts per billion by weight or more, indicative of production fluids produced from the formation that will contain mercury to be mitigated, at least in part, in a hydrocarbon processing facility. If mercury is present at these levels, then mercuric sulfide will likely be present in the crude oil, produced water or both. Facilities to remove mercuric sulfide from these phases may be included in the design. Likewise, facilities to remove mercury from natural gas may be included in the design when the mercury content of formation samples exceeds the limits indicated above. Likewise, facilities to remove mercury from produced water may be included in the design, e.g. when the mercury content of the produced water is greater than 100 parts per billion by weight.

In one embodiment, crude oils from the newly investigated production zone which contain less than 25 parts per million by weight of mercaptans are predicted to contain mercury, and for which a mercury removal process is to be employed when processing the crude oil. Other embodiments include crude oils containing less than 10 parts per million by weight, crude oils containing less than 5 parts per million by weight, or crude oils containing less than 3 parts per million by weight, which are predicted to contain mercury to be mitigated during crude processing.

Alternatively, in one embodiment, crude oils from the newly investigated production zone that contain less than 25 parts per million by weight of mercaptans are predictive of natural gas from the production zone for which mercury mitigation is indicated when processing the gas. Likewise, other embodiments include crude oils containing less than 10 parts per million by weight, crude oils containing less than 5 parts per million by weight, or crude oils containing less than 3 parts per million by weight, which are indicative of natural gas that contains mercury to be mitigated during natural gas processing.

In one embodiment, natural gas that is recovered from a production zone is analyzed for hydrogen sulfide. Natural gas which contains less than 50 parts per million volume hydrogen sulfide is predicted to contain mercury, at least a portion of which is to be removed when processing the gas. Other embodiments include natural gas containing 25 parts per million volume or less, natural gas containing 10 parts per million volume or less or natural gas containing 1 parts per million volume or less of hydrogen sulfide is indicative of natural gas that contains mercury to be removed during gas processing.

In one example of a production zone with natural gas, the inorganic matrix sample contains greater than 10 parts per billion by weight mercury (or alternatively in a range from 10 parts per billion by weight and 100 parts per million by weight or alternatively in a range from 10 parts per billion by weight and 1000 parts per billion by weighty) and the crude oil from the zone contains less than 25 parts per million by weight mercaptans, mercury mitigation treatment is anticipated. In another example, the inorganic matrix sample contains greater than 10 parts per billion by weight mercury (or alternatively in a range from 10 parts per billion by weight and 100 parts per billion by weight or alternatively in a range from 10 parts per billion by weight and 1000 parts per billion by weight) and the crude oil from the zone contains less than 3 parts per million by weight mercaptans, mercury mitigation treatment is also expected. In another example of the production zone having inorganic matrix sample containing greater than 10 parts per billion by weight mercury (or alternatively in a range from 10 parts per billion by weight and 100 parts per billion by weight or alternatively in a range from 10 parts per billion by weight and 1000 parts per billion by weight) and the natural gas from the zone contains less than 25 parts per million by weight (or less than 3 parts per million by weight) mercaptans, natural gas from the production zone is expected to require a mercury mitigation treatment.

In embodiments, the method provides for predictive models including a knowledge base of data correlating measured mercury contents from inorganic matrix samples with mercury contents of production fluids from a multiplicity of hydrocarbon production zones. The predictive model may be based on data collected from a wide range of production zones, including production zones with little or no mercury content. The model may include data from a wide range of wellbores in a large region, including wellbores from various locations over the entire earth. The model may further include data from wellbores in the same formation, or in similar formations, as that of the newly investigated production zone.

Samples from the inorganic matrix and samples of organic materials collected from the wellbore from within the production zone provide the raw data for predicting mercury content of the hydrocarbons to be produced from the zone. Inputting the mercury content of an inorganic matrix sample from the newly investigated production zone yields a prediction of the mercury content of a production fluid, such as natural gas, from the production zone as one output from the model, and from which determinations can be made of the need for mercury mitigation treatment during processing of the production fluids.

Besides planning for mercury mitigation treatment, analysis of samples collected from the wellbore may also be helpful in exploration and production planning. If mercury is found confined in certain (narrow) zones in the reservoir, plans can be made to block production from the zone(s) with high anticipated mercury contents based on analysis of samples having high mercury from these zones. Zone abandonment treatment technology is known in the art, including the use of gel technology for temporary or permanent blockage in oil field applications.

In one such embodiment, the knowledge base correlates measured mercury contents from inorganic matrix samples and mercaptan content of liquid hydrocarbon production fluids from the multiplicity of production zones with mercury contents of production fluids from the multiplicity of hydrocarbon production zones. In one such embodiment, the knowledge base correlates measured mercury contents from inorganic matrix samples and mercaptan content of natural gas from the multiplicity of production zones with mercury content of natural gas from the multiplicity of hydrocarbon production zones. In this way, the predictive model is indicative of the amount of mercury removal to be considered for treating production fluids from the newly investigated production zone. It is therefore an input into the design of a hydrocarbon processing facility for the newly investigated production zone. The model provides an early warning system for a newly investigated production zone, during the early stages of the well completion process when mercury measurement of produced gases may be difficult and unreliable.

In one embodiment, the predictive model includes a predicted mercury content of natural gas from the newly investigated production zone. An enhanced predictive model includes the mercury content of the inorganic matrix and the mercaptans content of the produced hydrocarbon liquid as input; an output of the model includes a predicted mercury content of the produced gases, and optionally a predicted mercury content of the liquid organic production fluids. A further enhanced predictive model also includes measurements of the hydrogen sulfide content of the gaseous hydrocarbons that are produced. A further enhanced predictive model also includes a representative temperature of the production zone. A further enhanced predictive model includes a measure of the water content of the producing formation. A further enhanced predictive model includes the pH of the water in the producing formation. For example, the model for predicting the mercury content of produced hydrocarbons may include a determination of the temperature of the formation in the region of the production zone. Various methods for determining the downhole temperature are known, and include extending a thermocouple within the wellbore to the production zone, extending a fiber optic cable within the wellbore to the production zone, supplying the wellbore in the region of the production zone with powered or non-powered temperature detection and electromagnetic transmission capabilities to communicate with surface detectors. A method for measuring the temperature of the near-well production zone is described, for example, in US20080061789, incorporated herein by reference in its entirety.

Knowledge of the mercury content may be used to influence the decisions regarding design, construction and use of mercury mitigation equipment for the production fluids. Use of the model result in this way may be applied to single wells in a formation that is yet to produce, is newly producing, or has a history of hydrocarbon production. The model may also be used for predicting the effect of the mercury content of production fluids generated from a well that is one of a number of wells producing hydrocarbons from a common formation, or that is supplying hydrocarbon products to a common hydrocarbon processing system.

The predictive model may be based on data collected from a wide range of producing formations, including from production zones with little or no mercury content. The model may include data from a wide range of wellbores in a large region, including wellbores from locations in different continents. The model may further include data from wellbores in the same formation, or in similar formations, as that of the newly investigated production zone.

The mercury mitigation treatment methods that are included in the design of the hydrocarbon processing facility depend on the production fluid being treated and the form of mercury in the fluid. A number of methods are available for removing mercury from crude oil and from produced hydrocarbon gases in a hydrocarbon processing facility. Methods for removing mercury from produced fluids involves, for example, one or more of filtration, centrifugation, extraction, thermal decomposition, an electrostatic separation process, fractionation by boiling point or freeze point, redox reaction followed by absorption by a chelating agent or complexing agent, absorption into a separate liquid phase, and adsorption/absorption onto a solid phase that has been prepared to immobilize mercury. One or more of these methods may be found in one or more of the following: US20030116475A1, US20100000910A1, US20120067784A1, US20120067785A1, US20120125817A1, US20120125818A1, US20120125820A1, US20130306310A1, US20130306311A1, US20140066683A1, US20140151040A1, US20140158353A1, US20140275665A1, US20140275694A1, US20150076035A1, U.S. Pat. No. 3,928,158A, U.S. Pat. No. 5,308,586A, U.S. Pat. No. 4,059,498A, U.S. Pat. No. 6,117,333A, U.S. Pat. No. 6,537,443B1, U.S. Pat. No. 8,673,133B2, U.S. Pat. No. 8,728,303B2, U.S. Pat. No. 8,728,304B2, U.S. Pat. No. 8,790,427B2, U.S. Pat. No. 8,840,691B2, U.S. Pat. No. 8,906,228B2, U.S. Pat. No. 8,992,769B2, U.S. Pat. No. 9,023,123B2, and U.S. Pat. No. 9,023,196B2, the entire disclosures of which are incorporated by reference.

In one embodiment, the production fluid is crude oil, wherein 10 wt. % or more of the mercury will be in the form of particulate Hg; in another embodiment, 25 wt. % or more; in yet another embodiment, 50 wt. % or more will be in the form of particulate Hg. Percent particulate mercury is measured by filtration using a 0.45 micron filter or by using a modified sediment and water (BS&W) technique described in ASTM D4007-11.

With regard to a liquid organic production fluid, in one illustrative embodiment, mercury is removed by filtering, by centrifugation, or a combination. Filtering and centrifugation are generally effective for removing particulates that contain Hg, either in compound form such as sulfides or oxides, or as adsorbed Hg on inorganic particulates in the fluid. In one illustrative embodiment, mercury is removed from organic liquids, such as crude oil, by reaction with active sulfur compounds such as an alkali or alkaline earth metal sulfide, polysulfide, trithiocarbonate or dithiocarbamate. Methods of this type are taught, for example, in U.S. Pat. No. 6,537,443 and U.S. Pat. No. 6,685,824, incorporated herein by reference in their entirety.

In another illustrative embodiment, mercury is removed from crude oil by contacting the crude oil with an oxidizing agent, and extracting at least a portion of the mercury into a water phase for subsequent separation from the crude oil. An oxidizing agent may selected from the group of halogens, halides and oxyhalides, hydroperoxides, organic peroxides and hydrogen peroxide, inorganic peracids and salts thereof, organic peracids and salts thereof, and ozone. The amount of oxidants used should be at least equal to the amount of mercury to be removed on a molar basis, if not in an excess amount. The contact can be carried out at room temperature or at an elevated temperature (e.g., from 30-80° C.) for a period of time, generally ranging from seconds to 1 day. The volume ratio of water containing oxidants to crude oil in one embodiment ranges from 0.05:1 to 5:1. A complexing agent may be added to facilitate the removal by forming soluble mercury complexes in the water phase. A suitable complexing agent is selected from the group of sulfides, thiosulfates, dithionites, and metal halides. The complexing agents are employed in a sufficient amount to effectively stabilize (forming complexes with) the soluble mercury in the oil-water mixture. In an illustrative example, the sufficient amount expressed as molar ratio of complexing agent to soluble mercury is in a range from 1:1 to 5,000:1. A process of this type may be found, for example, in U.S. Pat. No. 8,721,874, the entire specification is incorporated herein by reference.

In another illustrative embodiment, at least a portion of the mercury in crude oil is removed by contacting the crude oil with an aqueous sulfide or polysulfide solution. Contacting conditions include a pressure in a range from ambient pressure (e.g. 1 atmosphere) to a pressure of 200 psig, and a temperature in a range from ambient temperature (e.g. 0° C.) to 200° C. Exemplary sulfides or polysulfides that are suitable for the sulfidic extraction include sodium sulfide (NaSH), potassium sulfide (KSH), and ammonium sulfide (NH4SH). The mercury can be further isolated and concentrated in downstream processing.

In another illustrative embodiment, mercury is removed from crude oil by thermal treatment and gas-stripping. The process transfers mercury from crude oil to a gas stream, from which the mercury is removed with a commercially available adsorbent material. In one such embodiment, crude oil is pumped to a pressure to maintain the material in the liquid phase in the subsequent heating step at a temperature at which at least a portion of the mercury in mercury compounds in the crude oil is converted to elemental mercury. In one such embodiment, the crude oil is heated to a temperature of at most 300° C. (e.g. in a range from 80° C. to 300° C.). Heating times will vary, depending on the crude oil being treated. But, in general, the crude oil will be maintained at the temperature for at least 1 minute, and generally for longer than 30 minutes (e.g. 30 minutes to 5 hours). During the heating step to convert mercury compounds to elemental mercury, the crude oil is maintained at a pressure in a range from atmospheric pressure to 200 psig; in one embodiment in a range from atmospheric pressure to 100 psig. The heated and pressurized crude oil is then cooled to a temperature below 100° C. This cooling may be done first by feed-effluent heat exchange, followed by a secondary heat exchanger using suitable cooling medium. The cooled crude may be de-pressurized to a lower pressure for the subsequent stripping step to minimize the solubility of stripping gas and elemental mercury in the crude oil stream. The de-pressurization can take place by a pressure-control valve, restriction orifice, or in a device that recovers energy from the pressure change.

After cooling, the crude oil is stripped by passing a gaseous material through the crude oil at a temperature in a range from 0° C. to 100° C. Exemplary gaseous materials that are suitable for the stripping step include methane, natural gas, or nitrogen. In one embodiment, natural gas is used as the gaseous material, the natural gas having been treated in, for example, a mercury removal unit that uses an adsorbent to remove mercury from the natural gas prior to the stripping step.

Depending on the source, the crude oil feed can have an initial mercury level such as mercury of at least 50 parts per billion. In one embodiment, the initial level is at least 5,000 parts per billion. Some crude oil feed may contain from about 2,000 to about 100,000 parts per billion by weight of mercury. In one embodiment, the mercury level in the crude oil is reduced to 100 parts per billion by weight or less. In another embodiment, the level is brought down to 50 parts per billion by weight or less. In another embodiment, the level is 20 parts per billion by weight or less. In another embodiment, the level is 10 parts per billion by weight or less. In another embodiment, the level is 5 parts per billion by weight or less. In yet another embodiment, the removal or reduction is at least 50% from the original level of mercury. In another embodiment, at least 75% of a mercury is removed. In another embodiment, the removal or the reduction is at least 90%.

Method for removing mercury from natural gas are known. Exemplary solid materials for adsorbing mercury from natural gas include metallic sulfides such as copper sulfide, carbonaceous materials such as carbon, sulfurized carbon and halogenated carbon, and zeolites, optionally with gold or silver.

An exemplary method for removing mercury from natural gas includes contacting the natural gas with a glycol solution, optionally containing a complexing agent. The glycol solution may include either diethylene glycol (DEG) or triethylene glycol (TEG). In one embodiment, the glycol solution is employed in a concentration ranging from 99.1% up to 99.95% wt, in an amount sufficient to strip water at a rate of 0.5-6 scf of gas feed/gallon of glycol, for a dehydrated gas having water specifications of less than 1 lb./MMSCF (Million Standard Cubic Feet). The complexing agent may include, for example, one or more of ammonium polysulfide, amine polysulfides, and sulfanes. The gas feed may be dehydrated prior to, or during the contacting step. Non-volatile mercury in the glycol solution may be further isolated and concentrated using, for example, filtration, centrifugation, precipitation, stripping, distillation, adsorption, ion exchange, electrodialysis, contact with a hydrocarbon stream, and combinations thereof.

The glycol contacting step may be preceded by contacting natural gas containing acid gas such as hydrogen sulfide or carbon dioxide with an absorption solution in an absorber, the absorption solution comprising an amine and a first complexing agent. Examples of amines suitable for use in the scrubbing solution include but are not limited to MEA, DEA, TEA, DIPA, MDEA, and mixtures thereof. In an exemplary process, the ratio of absorbed acid gases to amine ranges from 0.3 to 0.9. The amine concentration (as wt. % of pure amine in the aqueous solution) may range from 15-65%. The amine solution may further remove at least a portion of the mercury in the gas feed. In one embodiment, the natural gas following the amine contacting step contains less than 50 wt. % of the mercury present in the natural gas preceding the amine contacting step. The treated gas feed with a reduced amount of acid gases is then be contacted with a glycol solution in a dehydrator, wherein the glycol solution contains a second complexing agent. A glycol solution enriched in mercury and a gas stream that is depleted in mercury is recovered. In one embodiment, the gas stream following the glycol treatment contains less than 50 wt. % of the mercury in the gas stream after the amine treating step but prior to the glycol treatment.

Examples of complexing agents include but are not limited to water-soluble sulfur species, e.g., sulfides, hydrosulfides, and organic and inorganic polysulfides thiocarbamate, dithiocarbamate, for extracting mercury in natural gas into the aqueous phase as precipitate (e.g., HgS) or soluble mercury sulfur compounds (e.g. HgHS2- or HgS22-). Other examples of complexing agents that can be used for the removal of mercury from the amine unit includes mercaptans, organic polysulfides (compounds of the general formula R-Sx-R' where x is greater than 1 and R and R' are alkyl or aryl groups), sulfanes and combinations thereof.

The amount of complexing agents to be added to the amine scrubbing solution and/or the glycol solution is determined by the effectiveness of complexing agent employed. The complexing agent to be added to the amine scrubbing solution can be the same or different from the complexing agent added to the glycol solution. The amount is at least equal to the amount of mercury in the gas on a molar basis (1:1), if not in an excess amount. In one embodiment, the molar ratio of complexing agent to mercury ranges from 5:1 to 10,000:1. In one embodiment with the use of a water-soluble sulfur compound as a scrubbing agent, a sufficient amount of the complexing agent is added to the amine scrubber for a sulfide concentration ranging from 0.05 M to 10M in one embodiment. If the mercury complexing agent is an organic polysulfide, sulfane or mercaptan, the moles of complexing agent are calculated on the same basis as the amount of sulfur present.

Removing mercury from natural gas is disclosed, for example, in copending patent application US20140072489, the entire disclosure of which is incorporated herein by reference for all purposes. Using an ionic liquid for removing mercury from natural gas is taught, for example, in US20070123660, which includes absorbing metal ions by a combination of a binding ligand and an ionic liquid, with the ligand being bound to a solid surface which is coated with the ionic liquid.

Mercury contained in water streams may be removed, for example, by filtering or centrifugation, particularly for particulate mercury compounds of a size suitable for separations of this type. Mercury, including dissolved mercury compounds and elemental mercury, may be oxidized prior to separation, using oxidizing agents such as oxygen-containing inorganic compounds of Group IA, Group IIA, Group IVA, Group IVB, Group VA, Group VB, Group VIA, Group VIB, Group VIIA and Group VIIB of the Periodic Table. Such oxygen-containing compounds include oxides, peroxides and mixed oxides, including oxyhalites. Examples of such oxidizing agents include vanadium oxytrichloride, chromium oxide, potassium chromate, potassium dichromate, magnesium perchlorate, potassium peroxysulfate, potassium peroxydisulfate, potassium oxychlorite, elemental halogens such as chlorine, bromine, iodine, chlorine dioxide, sodium hypochlorite, calcium permanganate, potassium permanganate, sodium permanganate, ammonium persulfate, sodium persulfate, potassium percarbonate, sodium perborate, potassium periodate, ozone, sodium peroxide, calcium peroxide, and hydrogen peroxide. Also contemplated are organic oxidizing agents such as benzoyl peroxide. Methods for removing mercury from water streams are taught, for example, in U.S. Pat. No. 6,117,333, the entire disclosure of which is incorporated herein by reference for all purposes.

In one embodiment, the mercury mitigation treatment is operated during periods of hydrocarbon production when the predicted mercury content of the hydrocarbon is greater than the threshold value, and is not operated during periods of hydrocarbon production when the predicted mercury content of the hydrocarbon is less than or equal to the threshold value.

EXAMPLES

The following exemplary embodiments of the invention illustrate methods for carrying out the invention. They are not to be construed as providing limitations to the method of the invention.

Example 1

A wellbore into a newly investigated production zone is prepared. When the drilling tool reaches the production zone in the formation, the tool is replaced with a coring tool for recovering a core sample from the production zone. The core sample is prepared as described herein to produce a ground inorganic sample having a size of less than 40 mesh. The ground inorganic sample is analyzed for mercury content, and found to contain less than 10 parts per billion by weight of mercury. Since the mercury content in the inorganic sample is below a threshold amount of 10 parts per billion by weight mercury, the quantity of mercury in production fluids that will be produced from the wellbore is predicted to be negligible. Construction of mercury mitigation equipment in the hydrocarbon processing facility is not indicated.

Example 2

Example 1 is repeated. In this case, the inorganic sample is found to contain in a range of 10 to 1000 parts per billion by weight mercury. Since the mercury content of the inorganic sample is above a threshold amount of 10 parts per billion by weight, mercury mitigation treatment is included in the design of the hydrocarbon processing facility for the production zone.

Example 3

Example 1 is repeated. The ground inorganic sample is analyzed for mercury content, and found to contain between 10 parts per billion by weight and 100 parts per billion by weight mercury. A sample of liquid hydrocarbons is also recovered from the production zone of the wellbore, analyzed for mercaptans content as described herein, and found to contain greater than 25 parts per million by weight mercaptans. Since the mercaptans content in the liquid hydrocarbons is greater than 25 parts per million by weight and the mercury content in the inorganic sample is less than 100 parts per billion by weight mercury, the quantity of mercury in production fluids that will be produced from the wellbore is predicted to be negligible, and the gaseous hydrocarbons to be produced from the well are predicted to be transportable without requiring mercury mitigation treatment. Construction of mercury mitigation equipment in the hydrocarbon processing facility is not indicated.

Example 4

Example 1 is repeated. In this case, the inorganic sample is found to contain between 10 parts per billion by weight and 100 parts per billion by weight mercury, and the liquid hydrocarbon is found to contain in the range of 3 to 25 parts per million by weight mercaptans. Since the mercury content of the inorganic sample is greater than 10 parts per billion by weight, and the mercaptans content of the liquid hydrocarbon is less than 25 parts per million by weight, a mercury mitigation treatment is included in the design of the hydrocarbon processing facility for the production zone.

Example 5

Example 1 is repeated. In this case, the inorganic sample is found to contain between 10 parts per billion by weight and 100 parts per billion by weight mercury, and the liquid hydrocarbon is found to contain less than 3 parts per million by weight mercaptans. Since the mercury content of the inorganic sample is greater than 10 parts per billion by weight, and the mercaptans content of the liquid hydrocarbon is less than 25 parts per million by weight, a mercury mitigation treatment is included in the design of the hydrocarbon processing facility for the production zone.

Example 6

Example 1 is repeated. In this case, the inorganic sample is found to contain greater than 100 parts per billion by weight mercury, and the liquid hydrocarbon is found to contain in the range of 3 to 25 parts per million by weight mercaptans. Since the mercury content of the inorganic sample is greater than 10 parts per billion by weight, and the mercaptans content of the liquid hydrocarbon is less than 25 parts per million by weight, a mercury mitigation treatment is included in the design of the hydrocarbon processing facility for the production zone.

Example 7

A wellbore into a newly investigated production zone is prepared. The mercury content of the inorganic matrix and the mercaptans content of the liquid hydrocarbons from the production zone are evaluated in a knowledge base that correlates inorganic and organic analyses with mercury in the produced fluids. The mercury content of gas from the producing formation is predicted to be sufficiently high to warrant construction of mercury mitigation equipment for treating the gaseous hydrocarbons from the producing formation.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

What is claimed is:

1. A method for producing hydrocarbons having reduced mercury content from a newly investigated production zone in a subterranean formation, comprising:

providing a knowledge base of data from a plurality of hydrocarbon production zones, the data correlating a mercury content of a hydrocarbon produced from each of the plurality of production zones with at least one of:

a mercury content of at least one inorganic matrix sample from each of the plurality of hydrocarbon production zones;

a mercaptans content of at least one liquid crude oil sample from each the plurality of production zones;

a hydrogen sulfide content of at least one natural gas sample from each of the plurality of production zones;

evaluating the knowledge base of data using at least one measured value from a newly investigated production zone, the measured value selected from the group consisting of a mercury content of an inorganic matrix sample from the newly investigated production zone, a mercaptans content of a liquid crude oil sample from the newly investigated production zone, and a hydrogen sulfide content of a natural gas sample from the newly investigated production zone as inputs to the knowledge base;

predicting the mercury content of the hydrocarbon to be produced from the newly investigated production zone; and providing a mercury mitigation treatment for removing at least a portion of the mercury from the hydrocarbon to be produced when the predicted mercury content of the hydrocarbon is greater than a threshold mercury content.

2. The method of claim 1, wherein the hydrocarbon to be produced from the newly investigated production zone is selected from the group consisting of crude oil, condensate, natural gas, and combinations thereof.

3. The method of claim 1, wherein the threshold mercury content of the hydrocarbon is 10 parts per billion by weight.

4. The method of claim 1, wherein the threshold mercury content of the hydrocarbon is 100 parts per billion by weight.

5. The method of claim 1, further comprising providing mercury mitigation treatment when the predicted mercury content of the hydrocarbon to be produced is greater than 100 parts per billion by weight.

6. The method of claim 1, further comprising providing mercury mitigation treatment when the predicted mercury content of the hydrocarbon to be produced is in a range of 2,000 to 100,000 parts per billion by weight.

7. The method of claim 1, further comprising providing mercury mitigation treatment when the measured mercury content of the inorganic matrix sample from the newly investigated production zone is 10 parts per billion by weight or more.

8. The method of claim 1, further comprising providing mercury mitigation treatment when the measured mercury content of the inorganic matrix sample from the newly investigated production zone is 1000 parts per billion by weight or more.

9. The method of claim 1, further comprising providing mercury mitigation treatment when the measured mercaptan content of the crude oil from the newly investigated production zone is less than 25 parts per million by weight.

10. The method of claim 1, further comprising providing mercury mitigation treatment when the measured mercaptan content of the crude oil from the newly investigated production zone is less than 3 parts per million by weight.

11. The method of claim 1, further comprising providing mercury mitigation treatment when the measured hydrogen sulfide content of the natural gas from the newly investigated production zone is less than 50 parts per million volume.

12. The method of claim 1, further comprising providing mercury mitigation treatment when the measured hydrogen sulfide content of the natural gas from the newly investigated production zone is 1 parts per million or less.

13. The method of claim 1, wherein the mercury content of the at least one inorganic matrix sample from each of the plurality of hydrocarbon production zones and the inorganic matrix sample from the newly investigated production zone is determined by reducing the particle size of the inorganic matrix sample and analyzing a fraction having a particle size of at most 40 mesh for mercury content.

14. The method of claim 1, further comprising, prior to the step of evaluating the knowledge base of data using at least one measured value, investigating the production zone via a wellbore extending into the production zone.

15. The method of claim 14, wherein the wellbore extends into a plurality of production zones, at least one of which is predicted to produce mercury-containing hydrocarbons, and wherein the mercury mitigation treatment comprises blocking production from the at least one production zone that is predicted to produce mercury-containing hydrocarbons.

16. The method of claim 15, wherein production from the at least one production zone that is predicted to produce mercury-containing hydrocarbons is blocked when the predicted mercury content of the hydrocarbon that is to be produced from the at least one production zone is greater than 100 parts per billion by weight.

17. The method of claim 1, further comprising providing mercury mitigation treatment when produced water recovered from the production zone contains greater than 100 parts per billion by weight of mercury.

18. The method of claim 1, wherein mercury mitigation treatment is selected from the group consisting of filtration, centrifugation, extraction, thermal decomposition, an electrostatic separation process or combinations thereof.

19. The method of claim 1, wherein the mercury mitigation treatment reduces the mercury content of the hydrocarbon to less than 100 parts per billion by weight.

20. The method of claim 1, wherein the mercury mitigation treatment is operated during periods of hydrocarbon production when the predicted mercury content of the hydrocarbon is greater than the threshold value, and is not operated during periods of hydrocarbon production when the predicted mercury content of the hydrocarbon is less than or equal to the threshold value.

* * * * *